US011316265B2

(12) United States Patent
Noras et al.

(10) Patent No.: US 11,316,265 B2
(45) Date of Patent: Apr. 26, 2022

(54) RADIATION SHIELD

(71) Applicant: SarGard Limited, Harrogate (GB)

(72) Inventors: James Noras, Bradford (GB); Rameez Asif, Bradford (GB); Richard Littlehales, Harrogate (GB); Raed Abd-Alhameed, Bradford (GB)

(73) Assignee: SarGard Limited, Harrogate (GB)

( * ) Notice: Subject to any disclaimer, the term of this patent is extended or adjusted under 35 U.S.C. 154(b) by 119 days.

(21) Appl. No.: 16/616,032

(22) PCT Filed: May 23, 2018

(86) PCT No.: PCT/GB2018/051398
§ 371 (c)(1),
(2) Date: Nov. 22, 2019

(87) PCT Pub. No.: WO2018/215765
PCT Pub. Date: Nov. 29, 2018

(65) Prior Publication Data

US 2020/0144714 A1 May 7, 2020

(30) Foreign Application Priority Data

May 23, 2017 (GB) ..... 1708242

(51) Int. Cl.
*H01Q 1/52* (2006.01)
*H01Q 1/24* (2006.01)
*H01Q 15/00* (2006.01)

(52) U.S. Cl.
CPC ..... *H01Q 1/526* (2013.01); *H01Q 1/245* (2013.01); *H01Q 15/0086* (2013.01)

(58) Field of Classification Search
CPC ..... H01Q 1/245; H01Q 1/526; H01Q 15/0086
See application file for complete search history.

(56) References Cited

U.S. PATENT DOCUMENTS 7,525,711 B1 4/2009 Rule et al.
9,325,047 B1 * 4/2016 Mumcu ..... H01P 1/20372
(Continued)

FOREIGN PATENT DOCUMENTS

CN 101162797 4/2008
CN 102802066 A 11/2012
(Continued)

OTHER PUBLICATIONS

Chinese Application No. 201880049411.6; Office Action dated Nov. 4, 2020, 6 pages.
(Continued)

*Primary Examiner* — Graham P Smith
*Assistant Examiner* — Jae K Kim
(74) *Attorney, Agent, or Firm* — Kilpatrick Townsend & Stockton LLP

(57) ABSTRACT

A shielding apparatus which is for passively attenuating electromagnetic radiation and which comprises a plurality of cells. Each cell comprises a plurality of resonators (26) which are spaced from one another. The cells are arranged in a plurality of unit cells with each unit cell comprising a common loop (32) which surrounds at least two adjacent cells of the plurality of cells. The plurality of unit cells each have an asymmetric structure. The shielding apparatus thus has a negative refractive index for at least one selected frequency whereby electromagnetic radiation at the at least one selected frequency is passively attenuated.

18 Claims, 13 Drawing Sheets

(56) References Cited

U.S. PATENT DOCUMENTS

| | | | | |
|---|---|---|---|---|
| 9,903,199 | B2 * | 2/2018 | Clarke | H01Q 19/062 |
| 11,011,282 | B1 * | 5/2021 | Dong | H01Q 15/0086 |
| 2001/0038325 | A1 * | 11/2001 | Smith | H01Q 1/364 333/202 |
| 2005/0073744 | A1 | 4/2005 | Zheludev et al. | |
| 2006/0044212 | A1 | 3/2006 | Wang et al. | |
| 2006/0125681 | A1 | 6/2006 | Smith et al. | |
| 2007/0188385 | A1 | 8/2007 | Hyde et al. | |
| 2008/0296710 | A1 * | 12/2008 | Tonucci | G02F 1/015 257/421 |
| 2009/0206963 | A1 * | 8/2009 | Nguyen | H01G 5/0136 334/14 |
| 2010/0141358 | A1 | 6/2010 | Akyurtlu et al. | |
| 2010/0314040 | A1 * | 12/2010 | Tyler, II | G02B 1/007 156/278 |
| 2011/0017910 | A1 | 1/2011 | Nagel | |
| 2011/0175672 | A1 * | 7/2011 | Nguyen | H01Q 15/0086 327/534 |
| 2011/0210903 | A1 * | 9/2011 | Sarabandi | H01Q 15/0053 343/904 |
| 2012/0105295 | A1 * | 5/2012 | Lin | H01Q 1/245 343/841 |
| 2014/0043194 | A1 * | 2/2014 | Seo | H01Q 17/00 343/720 |
| 2014/0111363 | A1 | 4/2014 | Alberth, Jr. et al. | |
| 2015/0369886 | A1 * | 12/2015 | Menon | G01R 33/365 324/322 |
| 2017/0186710 | A1 * | 6/2017 | Yoon | H01P 7/08 |
| 2018/0006381 | A1 * | 1/2018 | Hong | B32B 15/20 |

FOREIGN PATENT DOCUMENTS

| | | | |
|---|---|---|---|
| CN | 102969572 | A | 3/2013 |
| CN | 103983364 | A | 8/2014 |
| GB | 2495365 | A | 4/2013 |

OTHER PUBLICATIONS

Sabah et al., "Progress in Electromagnetics Research Symposium Proceedings", Aug. 20, 2009.

Naqui et al., "Novel Sensors Based on the Symmetry Properties of Split Ring Resonators (SRRs)", Sensors 2011, 7545-7553; doi: 10.3390/s110807545, Jul. 29, 2011.

Ates, Damla et al., Transmission enhancement through deep subwavelength apertures using connected split ring resonators, Optics Express; vol. 18, No. 4, Feb. 15, 2010, pp. 3952-3958.

Geschke, Riana H. et al., Filter Parameter Extraction for Triple-Band Composite Split-Ring Resonators and Filters, IEEE Transactions On Microwave Theory And Techniques, Plenum, USA, vol. 59, No. 6, Mar. 28, 2011, pp. 1500-1508.

Hui, Shi et al., Research on Electromagnetic Shielding Clothing, Cross Strait Quad-Regional Radio Science And Wireless Technology Conference (CSQRWC), 2011, IEEE, Jul. 26, 2011, pp. 211-213.

Milosevic, Vojislav et al., Classical Electromagnetically Induced Transparency in Metamaterials, Jan. 19, 2016, Retrieved from the Internet: URL:https://www.researchgate.net/publication/290260336_Classical_electromagnetically_induced transparency_in_metamaterials [retrieved on Jun. 29, 2018] figure 10, p. 79.

Mutlu, Mehmet et al., Asymmetric chiral metamaterial circular polarizer based on four U-shaped split ring resonators, Optics Letters, May 1, 2011, vol. 36, No. 9, whole document.

Naqui, Jordi et al., Novel Sensors Based on the Symmetry Properties of Split Ring Resonators (SRRs), Sensors, Jul. 29, 2011, vol. 11, No. 12, pp. 7545-7553.

Sabah, C. et al., Broadband Terahertz Metamaterial for Negative Refraction, Progress in Electromagnetics Research Symposium Proceedings, Aug. 21, 2009, p. 785, figure 1, p. 786.

Yoo, Y .J. et al., Flexible perfect metamaterial absorbers for electromagnetic wave, Journal of Electromagnetic Waves And Applications, Apr. 25, 2017, vol. 31, No. 7, pp. 663-715.

Search Report for GB1708242.1 dated Sep. 8, 2017.

Search Report and Written Opinion PCT/GB2018/051398 dated Jul. 13, 2018.

* cited by examiner

RADIATION SHIELD

TECHNICAL FIELD

The invention relates to a shield for reducing the energy radiated from a device such as a mobile phone or laptop.

BACKGROUND

Many modern day devices, for example mobile phones, laptops, and tablet computers, can transmit and receive radio frequency electromagnetic radiation. These transmissions are fundamental in providing functionality, such as internet connectivity, that users have come to regard as standard in these types of device.

An unfortunate side effect of these transmissions however is that the alternating radio frequency (RF) electric currents in the antenna will induce radio frequency electric fields that will penetrate the nearby tissue of the user. The energy radiated by these electric fields can be absorbed by the user's tissue causing an increase in the tissue temperature and potentially damaging the tissue.

To infer the degree of heating caused by these radio frequency fields it is standard practice to measure the radiation power absorbed per unit mass of material (i.e. tissue), which is known as the Specific Absorption Rate 'SAR'.

To protect the public against possible harmful effects of radio frequency radiation, a number of professional bodies have defined safety limits for the specific absorption rate in human tissue: for example the Institute of Electrical and Electronics Engineers 'IEEE' suggest an SAR limit of 1.6 Watts per Kilogram (Kg) averaged over any 1 gram (g) in the head over any 6 minute interval.

To reduce the SAR, radio frequency devices require a radio frequency shield to be placed between the user and the RF emitting antenna. Many such shielding devices are already commercially available for use with emitter devices such as, for example, mobile phones. These shields typically involve a solid mass of electromagnetic frequency 'EMF' shielding material placed adjacent to the mobile device; for example a "sock" or cover designed to fit around a mobile phone, or a special patch of material sewn into clothing pockets.

A common problem however with currently available devices is that, in addition to shielding the user from harmful radiation, they also block the antenna transmissions and in doing so reduce antenna efficiency. Reducing antenna efficiency obviously has implications for usability of the device by making the wireless connections which rely on the radio transmissions less reliable. Current shields also tend to be unduly large, severely affecting the form factor and usability of the mobile device.

Hence there is a need for a radio frequency shielding device which also does not interfere with antenna efficiency or generally impact the usability of the device.

It will also be appreciated that the radiation shield presented herein will not only be a benefit to mobile devices but also to a range of radiation shielding applications: for example protective clothing for those working or living near radio frequency base stations or radiation shielding built into walls.

DESCRIPTION

According to the present invention there is provided an apparatus and method as set forth in the appended claims.

Other features of the invention will be apparent from the dependent claims, and the description which follows.

According to a first embodiment, there is provided a shielding apparatus for passively attenuating electromagnetic radiation comprising a plurality of cells with each cell comprising a plurality of resonators which are spaced from one another; wherein the plurality of cells has an asymmetric structure.

The plurality of cells may be arranged in a plurality of unit cells with each unit cell comprising a common loop which surrounds at least two adjacent cells of the plurality of cells. The plurality of unit cells may each have an asymmetric structure which has a negative refractive index for at least one selected frequency whereby electromagnetic radiation at the at least one selected frequency is attenuated. The attenuation is preferably passive, i.e. caused by the structure of the unit cells, rather than active attenuation which would require electronic or other input.

An asymmetric structure is one which is not completely symmetric. Asymmetry can be achieved by adjusting various parameters of the structure, e.g. spacing around or between resonators or dimensions of the resonators. The asymmetry of the structure can be varied to trap and reflect electromagnetic waves at selected frequencies. Thus, the structure can be termed an electromagnetic bandgap structure because the structure resonates at and thus reduces the radiation from the selected frequencies (i.e. in the selected electromagnetic band).

The layout of the cells in each shielding apparatus is designed so that the shield has a negative refractive index for at least one selected frequency. The negative refractive index helps to suppress surface waves and radiate the excessive electromagnetic waves emitted from the user device away from the user. The shielding apparatus may thus be termed a metamaterial, i.e. a man-made composite structure which exhibits properties not usually found in natural materials, especially a negative refractive index.

Metamaterials have been studied previously but not in the context of shielding apparatus where there is passive attenuation. For example, US2007/0188385 to Hyde et al describes a metamaterial which is adjustable according to interactive feedback of interaction with electromagnetic waves. In Hyde the metamaterial is adjusted to provide focusing, e.g. of an optical beam. Furthermore, the focusing is achieved by using an electric field to change the physical properties of the metamaterial, i.e. there is active control of the metamaterial. Similarly, U.S. Pat. No. 7,525,711 to Rule et al describes an actively tunable electromagnetic material. The electromagnetic material may be used in a wide variety of applications, e.g. antennas, compact waveguides and beam shaping and is tunable by using a material which changes its capacitance when exposed to controlling electromagnetic radiation. An antenna isolation using metamaterial is discussed in GB2495365.

The common loop may comprise the outermost resonators of each cell arranged so that the resonators at least partially overlap. Each pair (or group) of cells may thus be effectively an overlapping structure.

At least one of the plurality of cells may comprise a first pair of adjacent resonators and a second pair of adjacent resonators and a spacing between the first pair of adjacent resonators is different from a spacing between the second pair of adjacent resonators whereby the at least one of the plurality of cells is asymmetric. Similarly, at least one of the plurality of unit cells may comprise a first cell having a first set of resonators and a second cell having a second set of resonators wherein a spacing between the first set of adjacent resonators is different from a spacing between the second set of resonators whereby the at least one of the plurality of unit cells has an asymmetric structure. Alternatively, the spacing between at least one pair of adjacent resonators may be non-uniform, i.e. the spacing may be larger along one side than along other sides. The different spacing may be used in all of the plurality of cells or unit cells.

Each of the plurality of resonators in at least one of the plurality of cells (and hence in at least one of the plurality of unit cells) may have a width which is different from its length whereby the at least one of the plurality of cells is asymmetric and hence the at least one of the plurality of unit cells has an asymmetric structure. For example, the resonators may be rectangular or oval with a width which may be longer than the length. The ratio of the width to length for each resonator within a cell may be the same for each resonator. All of the plurality of cells may have the same shaped and sized resonators. Thus all of the plurality of cells may be asymmetric to ensure that the plurality of unit cells each have an asymmetric structure.

The asymmetry of the structure may be achieved by combining the asymmetry of the width and length with the non-uniform or differing spacing or by adjusting individual parameters to achieve asymmetry. The asymmetry may be the same for each cell within the plurality of cells. Alternatively, some or all of the plurality of cells may be different to provide further asymmetry.

Each of the plurality of resonators in at least one of the plurality of cells may be a split ring resonator formed from a loop of conducting material with a gap in the loop. Suitable conducting materials include copper or nickel. Each gap may have the same width. Alternatively, further asymmetry may be introduced by using different sized gaps, e.g. by having different sized gaps within a cell or by having the same gaps within a cell but different gaps between adjacent cells.

Each gap within a cell may be aligned with the other gaps in the cell. For example, each cell may have an axis, e.g. one which passes through its centre, and the gaps may be aligned on the axis. The gap on a first resonator within a cell may be at an opposed position to a position of the gap on a second resonator within the cell, i.e. the gaps are effectively arranged 180 degrees from one another. This pattern of opposed positions may be repeated for each pair of adjacent resonators. The pattern of opposed positions may be used in some or all of the plurality of cells.

Each of the plurality of resonators in at least one of the plurality of cells may be concentric with one another. Each of the plurality of cells may have concentric resonators.

The plurality of cells comprises a plurality of unit cells each having at least a pair of adjacent cells surrounded by a common loop. Each unit cell may be a dual band unit cell whereby radiation at two electromagnetic frequencies is attenuated. These frequencies may be those defined by the standards, e.g. 900 MHz or 1800 MHz, but it will be appreciated that other frequencies, such as LTE 1, 2, & 3, may also be covered.

At least one of the plurality of unit cells has an asymmetric structure. For example, the spacing between the common loop and an adjacent resonator of each cell within the unit cell may be non-uniform, e.g. greater along one side than along the other sides, whereby the unit cell has an asymmetric structure. Thus, it appears as if one of the cells in the pair of cells has been rotated by 180 degrees with respect to a common y-axis for both cells. All of the plurality of unit cells may have the same asymmetric structure.

Each unit cell may comprise at least two additional resonators surrounding the common loop. The additional resonators may be split ring resonators. A gap in the first additional resonator may be positioned at an opposite end of the unit cell to a gap in the second additional resonator. There may be two or more additional resonators.

The plurality of cells may be in a shielding layer mounted on a substrate. The substrate may be formed from a dielectric material, for example with a dielectric constant between 2.2 and 4.4. The substrate may be flexible. The substrate may be thin, for example with a thickness between 0.13 mm and 1.6 mm. The plurality of cells and hence the shielding layer itself may be printed on the substrate.

The shielding apparatus described above can be used with various different user devices which emit electromagnetic radiation, e.g. mobile phones, laptops. Alternatively, an item of clothing may incorporate the shielding apparatus, for example, in protective clothing for pregnant women living in close vicinity to transmitters or base stations. The shielding apparatus may be large enough, i.e. have enough cells, to shield a house in close vicinity to transmitters or base stations or to shield a secure place to prevent eavesdropping.

According to a second embodiment, there is provided a user device incorporating the shielding apparatus of any of the preceding claims, the user device comprising an emitter emitting electromagnetic radiation; wherein the shielding apparatus is located adjacent to the emitter such that in use the shielding apparatus is between the user and the emitter.

The number of cells in the plurality of cells may be selected so that a surface area of the shielding device matches a surface area of the user device or the RF emitter.

BRIEF DESCRIPTION OF THE DRAWINGS

For a better understanding of the invention, and to show how embodiments of the same may be carried into effect, reference will now be made, by way of example only, to the accompanying diagrammatic drawings in which.

DETAILED DESCRIPTION OF THE DRAWINGS

Figure 1A:
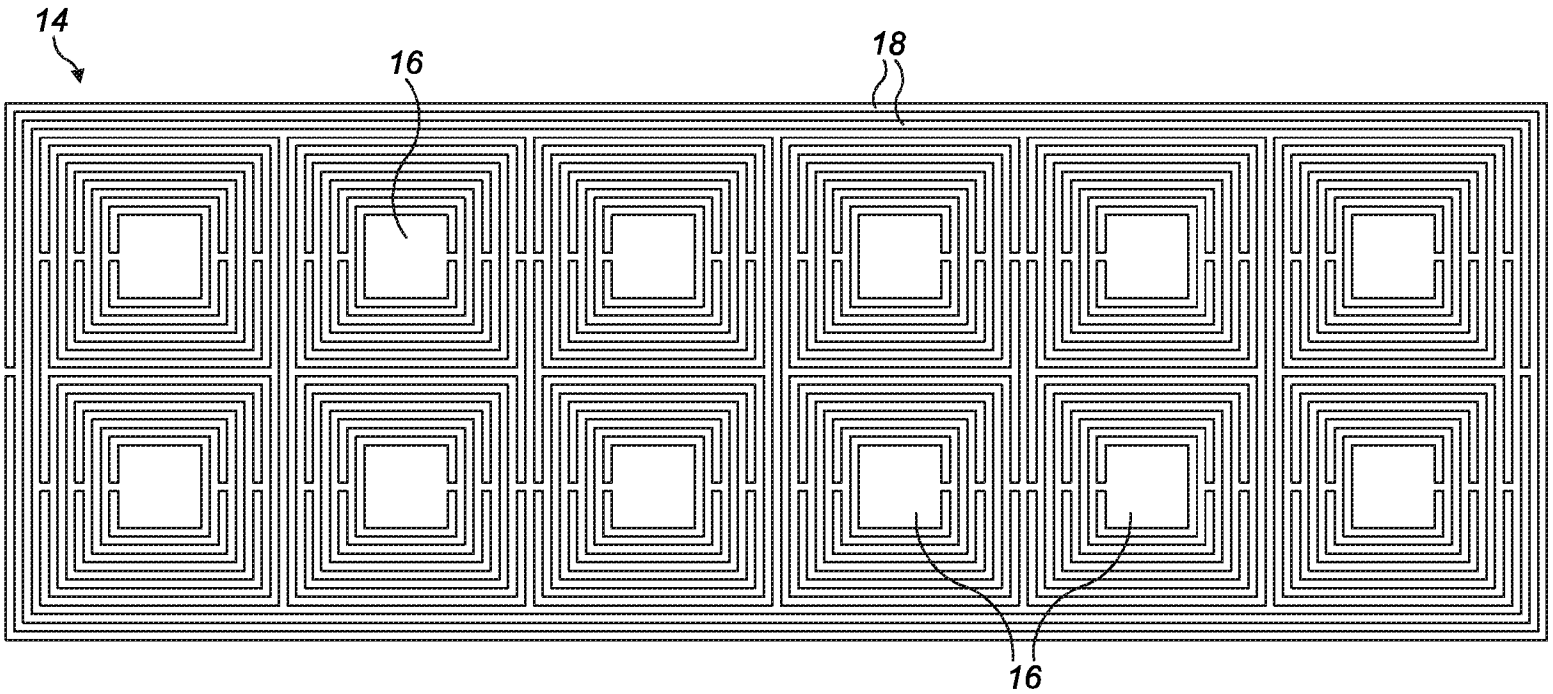
FIG. 1*a* is a plan view of a shield according to the present invention.
Figure 1B:
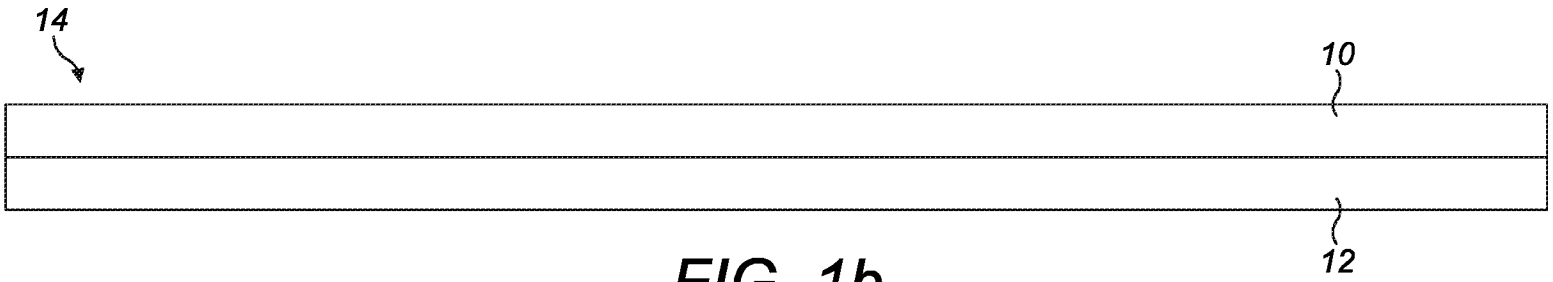
FIG. 1*b* is a side view of the shield of FIG. 1*a;*
Figure 1C:
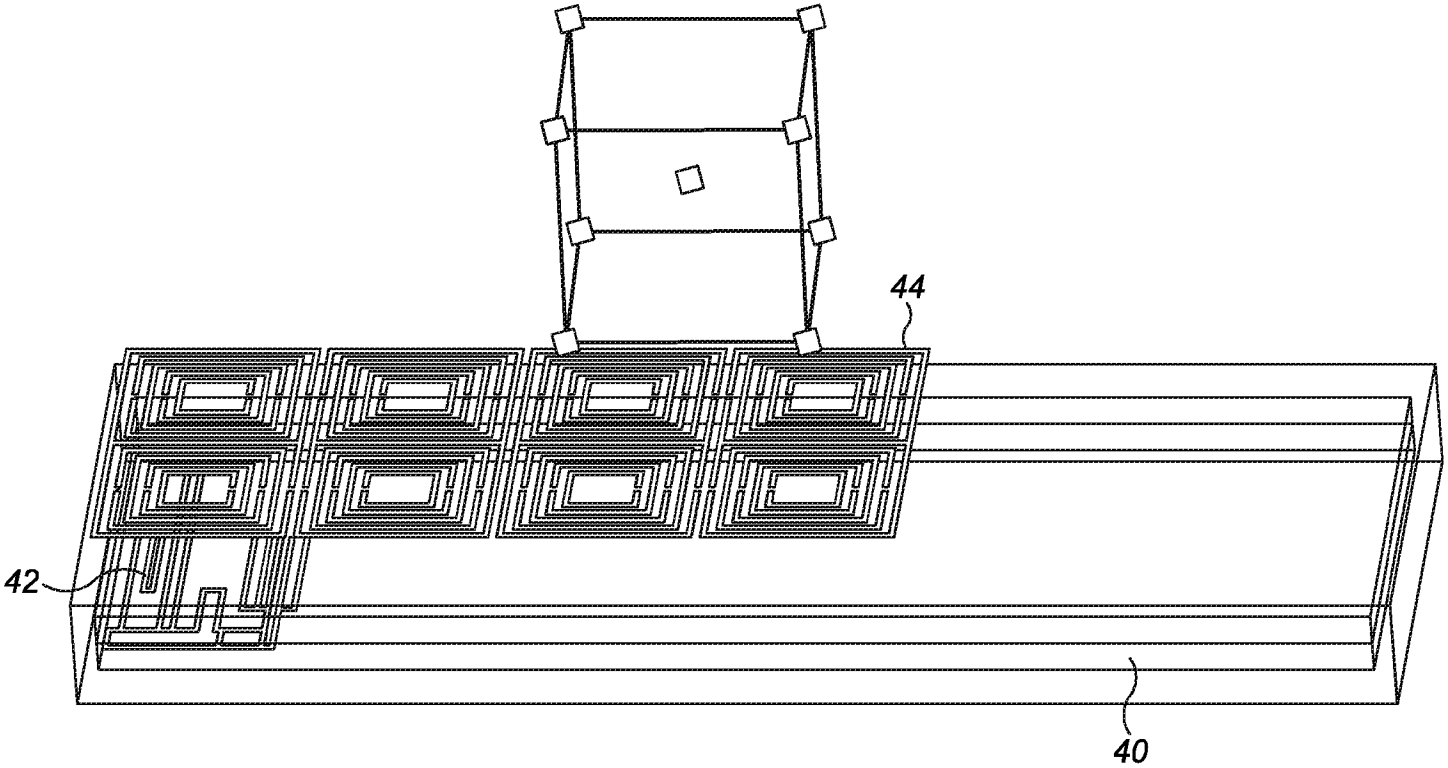
FIG. 1*c* is a schematic illustration of a shield according to the present invention mounted on a radiating device.

FIGS. 1*a* and 1*b* show a shield 14 (or shielding apparatus—the terms are used interchangeably) according to a first embodiment of the present invention. The shield 14 comprises a shielding layer 10 supported on a substrate 12. The shielding layer 10 comprises a circuit having a plurality of single cells 16 which are paired to form dual band unit cells and encapsulated within two separate ring structures 18 as described in more detail below. FIG. 1*c* is a schematic illustration of a shield 44 on a user device 40 having an antenna 42 which emits electromagnetic radiation. The shield is placed on the user device with the shielding layer facing the user device. The shield is spaced from the antenna by the depth of the user device which for a typical mobile phone is approximately 5 mm.

A known problem with radiating user devices is that energy from the electromagnetic radiation may be absorbed into the internal tissues (e.g. brain tissue) of a user using the user device 40. The shield of the present invention is designed to provide a shielding effect which reduces the specific absorption rate (SAR) of energy by the user whilst maintaining the radiation efficiency of the antenna.

The shield 14 in FIG. 1*a* has six dual band unit cells and the shield 44 in FIG. 1*c* has four dual band unit cells. In FIG. 1*c*, the location of the antenna is known and the shield can be located adjacent to the antenna so a shorter shield is sufficient to provide the desired shielding effect. The size of the shield in FIG. 1*a* is such that it matches the size of many current mobile phones. By covering the entire surface of the mobile phone, the shield will have the desired shielding effect regardless of the location of the antenna. Accordingly, such a shield can be used when the location of the antenna is not known.

The layout of the cells in each shield is engineered in such a way that the shield has a negative refractive index in the frequency band at which the user device 40 is emitting radiation. For example, if the user device 40 is a mobile phone, radiation is likely to be emitted at a specific frequency such as 900 MHz or 1800 MHz as defined by the standards. The negative refractive index helps to suppress surface waves and radiate the excessive electromagnetic waves emitted from the user device back to the user device or away from it. The shield may be termed a metamaterial. A metamaterial is defined as a synthetic or man-made composite structure which exhibits properties not usually found in natural materials, especially a negative refractive index.

The cells are formed from a conductive material, e.g. copper or nickel, which may be directly printed onto the substrate. In this way, the two separate layers shown in FIG. 1*b* effectively are a single layer.

The substrate is preferably thin, for example with a thickness between 0.13 mm and 1.6 mm, preferably light and optionally flexible but resilient and sturdy enough to support the shielding layer. The substrate is preferably a dielectric material, for example with a dielectric constant between 2.2 and 4.4. The substrate must not have any performance degradation on the shielding effect of the shielding layers. Suitable materials include laminates such as glass-reinforced epoxy laminates (e.g. grade designation FR4), glass-reinforced PTFE composites (e.g. RT-duroid 5880 or CuCad217) or glass-reinforced hydrocarbon/ceramics laminates. The properties for examples of suitable substrates are set out below but it will be appreciated that other suitable substrates may also be used:

| Type | Dielectric Constant | Thickness/mm |
|---|---|---|
| FR4 | 4.4 | 1.6 |
| FR4 | 4.4 | 0.8 |
| RT Duroid 5880 | 2.2 | 0.13 |
| RO4350B | 3.48 | 0.17 |
| CuClad 217 | 2.17 | 0.25 |

Figure 2A:
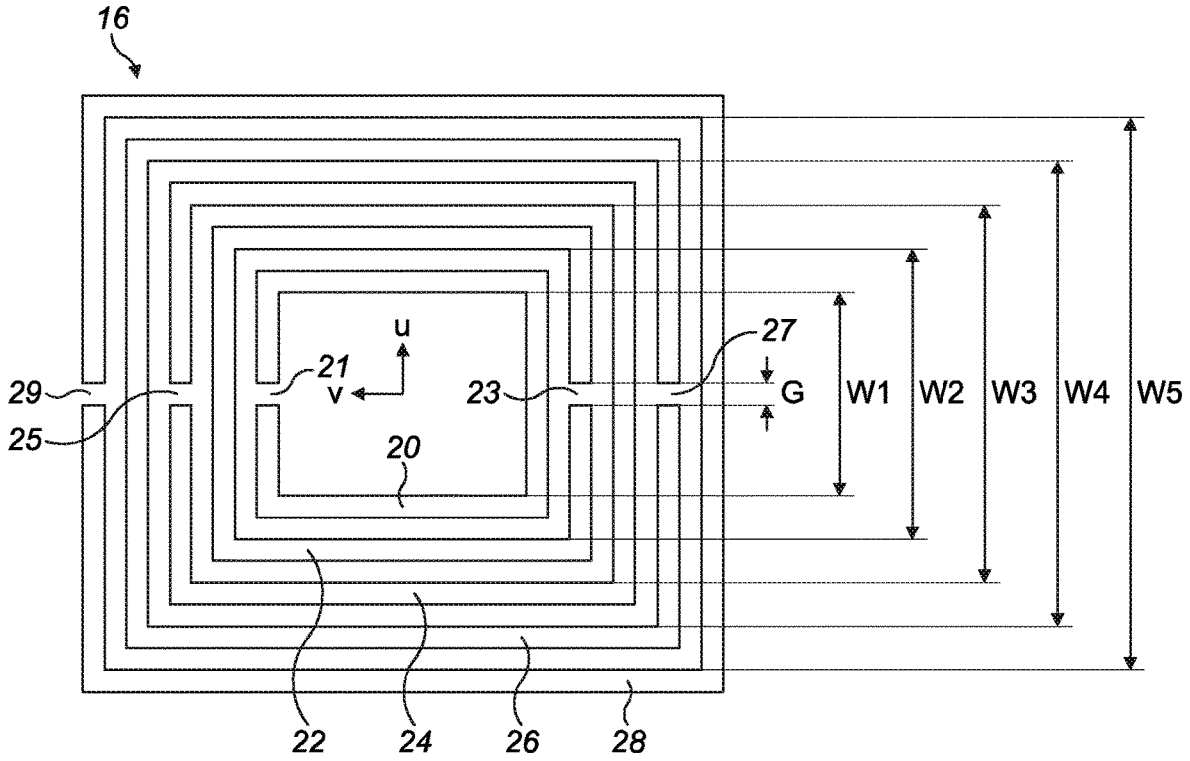
FIGS. 2*a* and 2*b* are plan views of a cell unit within the shield of FIG. 1*a;*
Figure 2B:
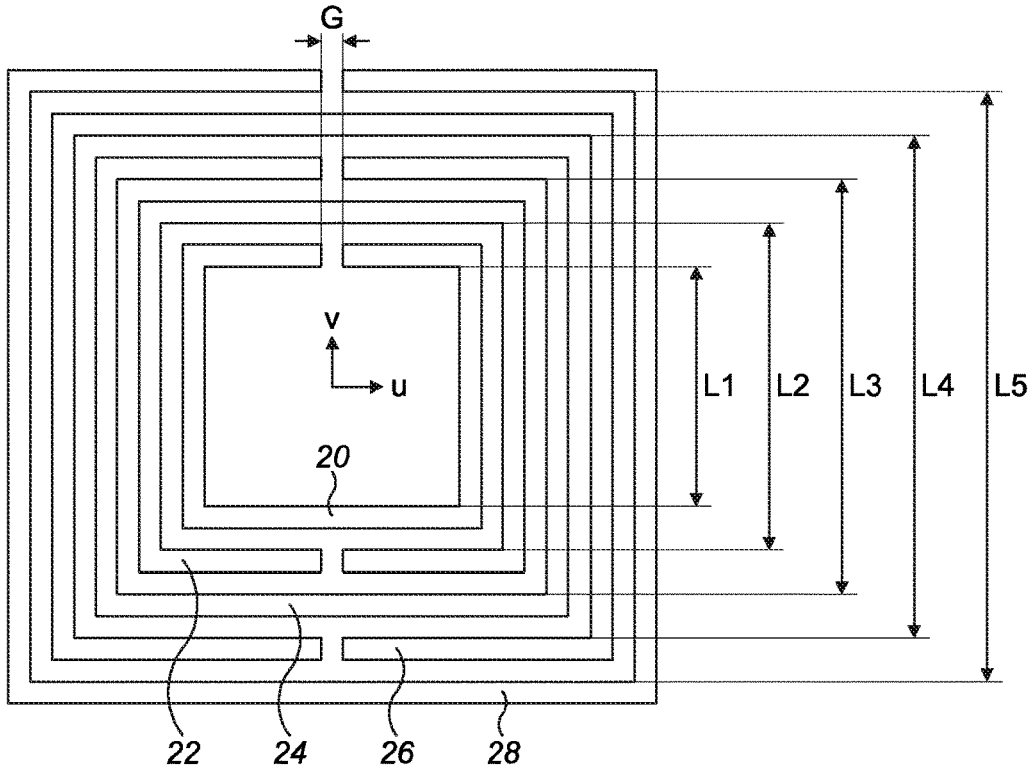

FIGS. 2*a* and 2*b* show a single cell 16 from the shielding layer of FIG. 1*a*. In this arrangement, the single cell 16 has five concentric split ring resonators. FIG. 2*b* is rotated through 90 degrees relative to FIG. 2*a* to indicate the relative dimensions of the concentric split ring resonators. It will be appreciated that five is merely illustrative and other numbers of resonators may be used.

Each split ring resonator is formed from a thin track (e.g. 1.5 mm) of conductive material which defines a substantially square loop having a gap in one side of the loop. The innermost (or first) loop 20 has an internal width of W1 and length of L1. The first loop has a single gap 21 which is positioned halfway along one side having a length equal to the internal width W1 and the width of the track. The next innermost (or second) loop 22 has an internal width W2, length L2 and its gap 23 is also positioned halfway along one side. The gap 23 in the second loop 22 is on the opposite side to the side of the first loop 20 having a gap 21. The alternating pattern of positioning the gaps on opposite sides is repeated for the next three loops. Accordingly, the third loop 24 of width W3 and length L3 and the fifth loop of width W5 and length L5 have gaps 25, 29 on the same side as the gap 21 in the first loop 20. Similarly, the fourth loop of width W4 and length L4 has a gap 27 on the same side as the gap 23 in the second loop 22. Each gap has the same width G and the gaps are also aligned with each other so that the centre point of each gap is on the same axis. The width W1 is slightly longer, e.g. approximately 5% longer, than the length L1 and thus the innermost loop is rectangular and almost square. Each of the other loops also is slightly wider than it is long and in this structure, the difference between the width W and the length L of each loop is the same for each loop.

Figure 2C:
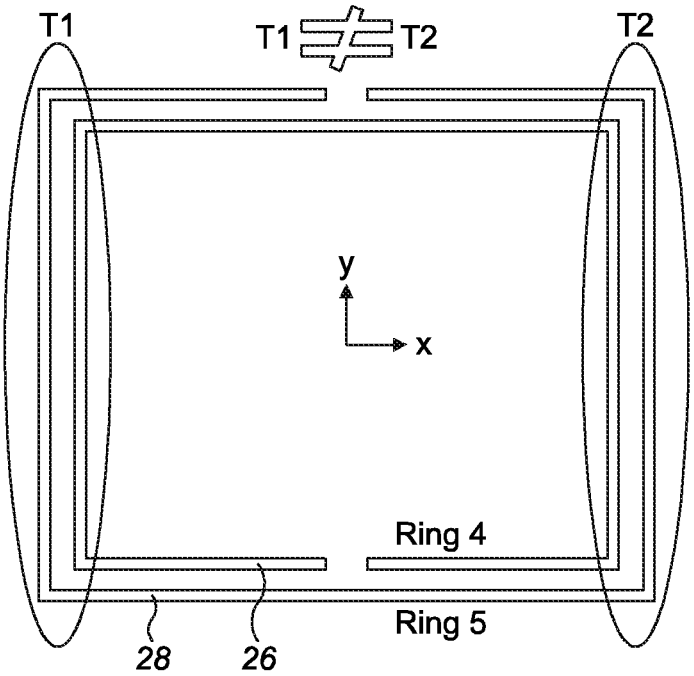
FIG. 2*c* is a schematic view of part of the cell unit of FIG. 2*a;*

As shown in FIG. 2*a*, there is spacing between each of the adjacent loops. The spacing around each of the first three loops is of uniform width T1 all around each loop. The width T1 may be the same size as the gap G, e.g. 0.5 mm. The spacing between the fourth and fifth loop is not uniform. The spacing has a width T1 along three sides and a smaller width T2 along the fourth side. FIG. 2*c* is a schematic drawing of just the fourth and fifth loops 26, 28 to illustrate this uneven spacing more clearly. The smaller spacing of width T2 is between two sides without gaps.

By having a non-uniform spacing between the fourth and fifth loops and a difference between the width and length of each loop, the overall structure of the unit cell in FIG. 2*a* is asymmetric or non-periodic. A structure having concentric square loops with equal width and lengths, equal sized and aligned gaps and equal spacing between loops would be a symmetric or periodic structure. It will be appreciated that adjusting the width and length of each loop and the spacing along one side between the fourth and fifth loops are just examples of achieving asymmetry and other variables could be varied to achieve asymmetry, e.g. the spacing and size of the or each gap, or the spacing between other loops or between other sides of loops. The asymmetry of the structure can be varied to absorb and reflect electromagnetic waves at selected frequencies. Thus, the structure can be termed an electromagnetic bandgap structure because the structure resonates at and thus reduces the radiation from the selected frequencies (i.e. in the selected electromagnetic band).

As set out above, the layout of the cells in each shield is engineered in such a way that the shield has a negative refractive index in the region of the frequency at which the user device 40 is emitting radiation. Each cell is designed to resonate at the emitted frequency. A negative refractive index and resonance at a particular frequency can be achieved by adjusting the parameters of a unit cell. The parameters may include some or all of the width and length of each loop, spacing between loops, gap position and size.

One method for calculating the refractive index (n) is to use a standard retrieval procedure. It will be appreciated that other techniques can also be used. As an example, the refractive index (n) and relative impedance (Z) using scattering parameters (also known as S-parameters).

The relative impedance (Z) and refractive index (n) can be written as $$Z = \pm\sqrt{\frac{(1+S_{11})^2 - S_{21}^2}{(1-S_{11})^2 - S_{21}^2}}$$

and $$n = -j\cdot\ln\left[\frac{S_{21}}{1 - S_{11}\left(\frac{Z-1}{Z+1}\right)}\right]\frac{1}{k_0 d}$$

where $k_0$ is the free space wave number and (d) is the thickness of the unit cell. $S_{11}$ and $S_{21}$ are entries in the scattering matrix which represents various scattering parameters.

The parameters, effective permittivity $\varepsilon_{eff}$ and effective permeability $\mu_{eff}$ for the shield were then derived using $$\varepsilon_{eff}=n/Z$$

$$\mu_{eff}=nZ$$

The above equations allow for determining the parameters and designing modifications for a single cell. For example, decreasing the spacing in the gaps between the split rings results in increased electromagnetic shielding at the 1800 MHz band and improved antenna efficiency. However, modifying a single cell does not solve the issue of dual band protection, which requires two cells as set out below.

Figure 3A:
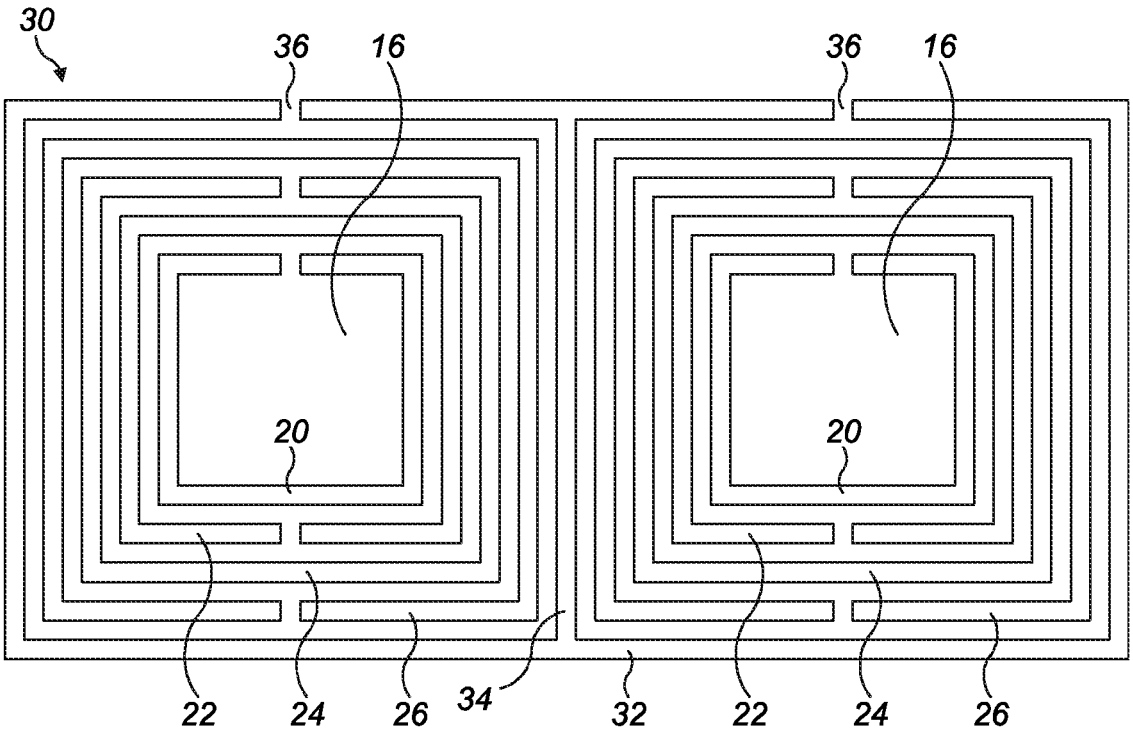
FIG. 3*a* is a plan view of a dual band unit cell incorporating two cell units of FIG. 2*a;*

FIG. 3*a* shows a dual band unit cell 30 which comprises two single cells 16 adjacent to one another. The parameters of the dual band unit cell can also be selected using the equations above. A dual band unit cell is designed to resonate at two different frequencies, e.g. 900 MHz and 1800 MHz which are two of the bands currently used by mobile phone operators. The dual band unit cell can be designed to resonate at any two frequencies, not just those which are multiples of one another. For example, two other commonly used bands for mobile phone operators are 850 MHz and 1900 MHz. For lower frequencies, a larger cell unit size is required to provide the desired resonance.

As shown in FIG. 3*a*, the first to fourth loops 20, 22, 24, 26 of each single cell are identical to those of the cell shown in FIGS. 2*a* and 2*b*. A common loop 32 forms the fifth loop for each cell. The common loop 32 has a track which forms a loop around both the adjacent cells. The track has two gaps 36 which are each equivalent to the gap 29 in the fifth loop of a single cell. Each of the gaps 36 in the common loop 32 is aligned with and equal in size to the gaps in the first and third loops of the respective single cells. The common loop 32 also has a divider 34 which extends between the side having two gaps and the opposite side of the common loop. The divider 34 forms one side of the fifth loop for both cells and thus extends between and is spaced from one side of the fourth loop for both cells. The divider 34 thus shorts the common loop 32.

Effectively, the dual band cell unit is an overlapped structure having 10 loops in total with 8 loops (one to four for each unit cell) enclosed inside the two overlapped loops (fifth loop of each cell). Experimental study has shown that such an overlapping arrangement is more effective in deflecting electromagnetic radiation than other pairings of single cells, e.g. a pairing with two cells aligned with and adjacent to each other or a pairing in which one cell has been rotated relative to the other, for example so that the gaps on the outer loops of each cell face each other. Results show that the overlapping structure is effective in deflecting the electromagnetic waves at both 900 MHz and 1800 MHz. However, due to the longer wavelength at 900 MHz, only 35% of the electromagnetic waves are deflected. Accordingly, as shown in FIG. 1*a*, the dual band unit cell can be enclosed within two or more loops to enhance the overall shielding performance without degrading antenna efficiency. The extra loops also do not affect the overall system frequency bands and the shield is still within the space constraints that an electrically small antenna (ESA) for low frequency such as 900 MHz can be easily covered. The extra loops may be open loop resonators in contrast to the split ring resonators of the smaller, inner loops.

To mirror the asymmetry of the single cell, the dual band unit cell 30 pairs the single cells together in an asymmetric way. This is illustrated by the inclusions of example dimensions in FIG. 3*a* which show that each gap 36 in the common loop 32 is 8.11 mm from the divider 34 but only 7.73 mm from a respective side of the common loop 32. It will be appreciated that these dimensions are merely illustrative and the asymmetry is shown more generally in the schematic diagrams of FIGS. 3*b* and 3*c*. As in the single cell, the spacing between three sides of the fourth loop 26 and three sides of the respective part of the common fifth loop 32 has a width T1 and the spacing between the fourth sides is smaller with width T2.

Figure 3B:
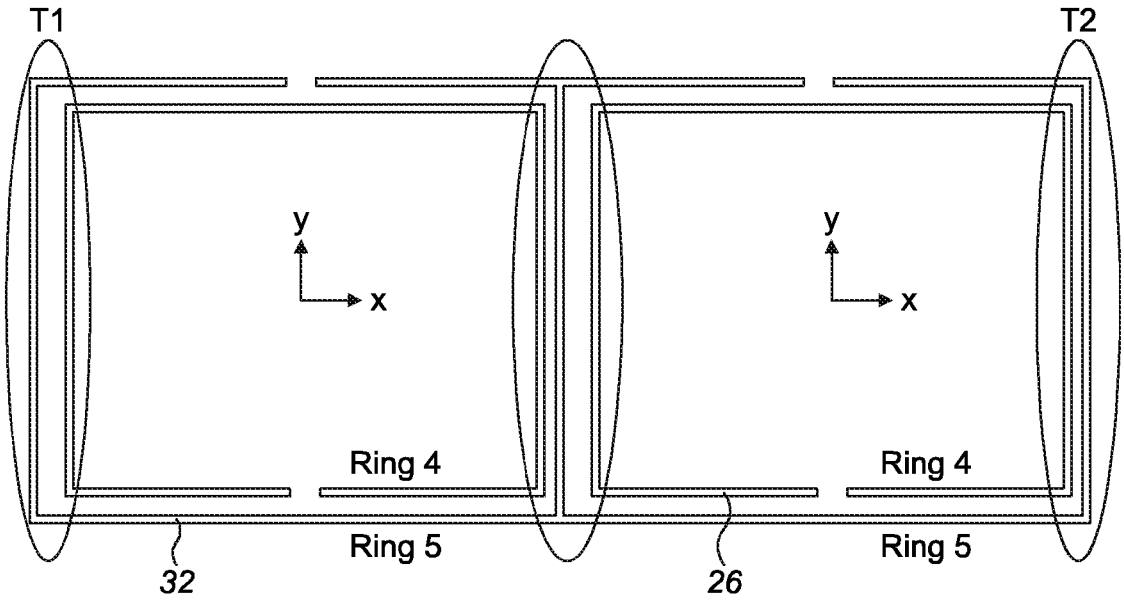
FIGS. 3*b* and 3*c* are schematic illustrations of the asymmetry of the dual band unit cell of FIG. 3*a;*
Figure 3C:
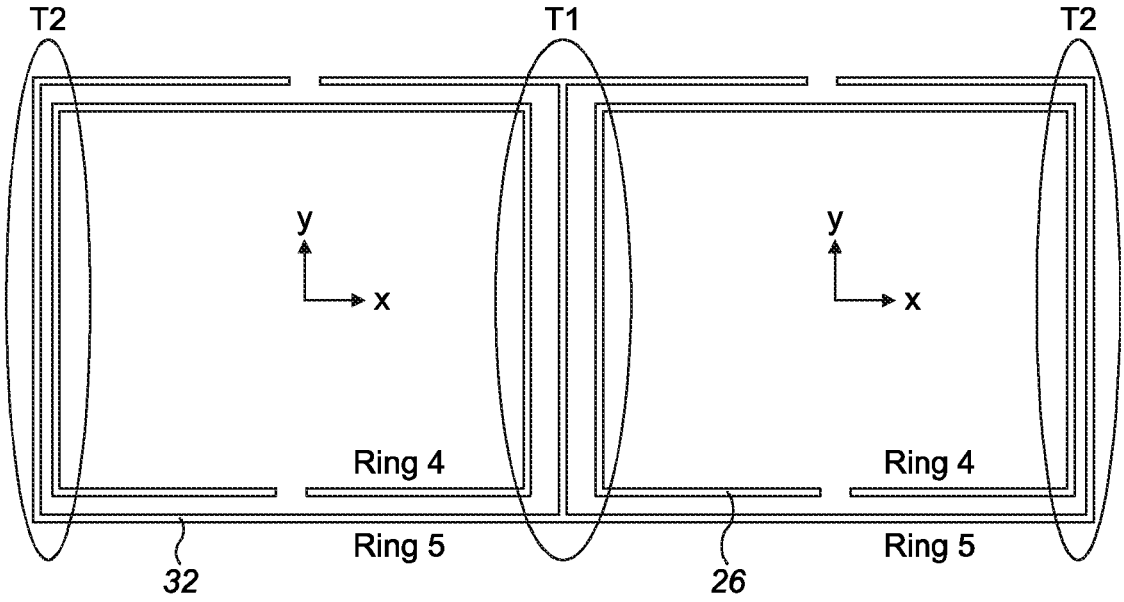

FIG. 3*b* illustrates one asymmetric arrangement in which the smaller spacing of width T2 is on the same side for both single cells. FIG. 3*c* illustrates an alternative asymmetric arrangement in which the smaller spacing of width T2 is adjacent to opposed short sides of the common loop 32. In other words, one cell is reflected in the y-axis relative to the other cell. Experimental study has shown that both the arrangements of FIGS. 3*b* and 3*c* are capable of resonating at dual frequency bands. However, the arrangement of FIG. 3*b* degrades the performance of the antenna more than that of FIG. 3*c*. The study shows that the arrangement of FIG. 3*b* negatively affects the antenna S-Parameter and produces a frequency shift in the centre frequency of the GSM antenna. These effects are avoided in the arrangement of FIG. 3*c*.

Figure 4A:
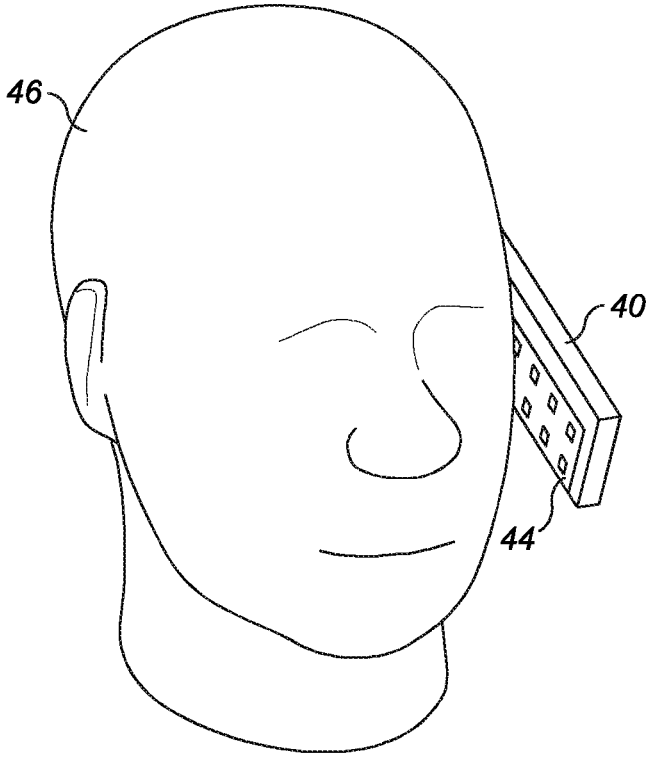
FIG. 4*a* is a perspective view of a mobile device incorporating a shield according to the present invention adjacent a user's head.
Figure 4B:
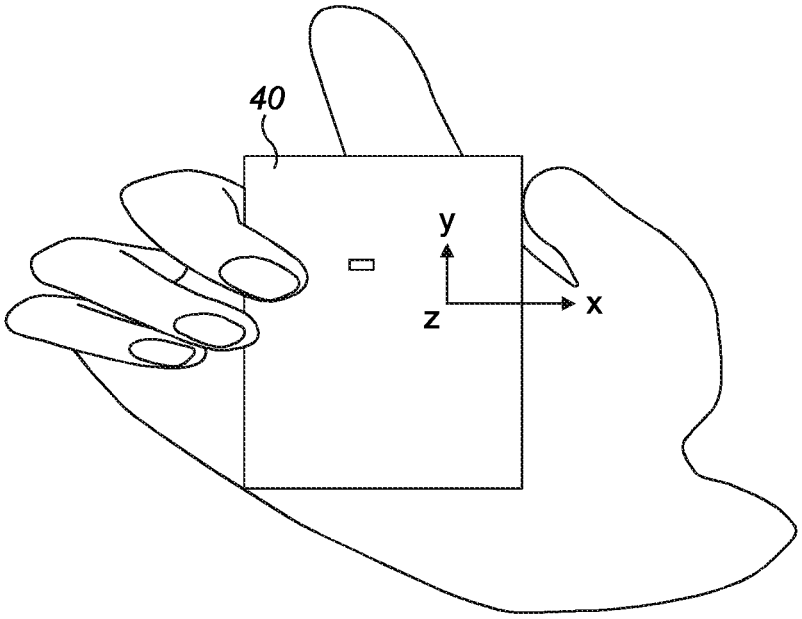
FIG. 4*b* is a perspective view of the mobile device of FIG. 3*a* in a user's hand.

The shield described above can be used with various different user devices. FIG. 4*a* shows a mobile device 32 incorporating a shield 34 as described above. The mobile device 32 is positioned next to a user's head 30. FIG. 4*b* shows the mobile device 32 with a shield in a user's hand.

The performance of the shielded device has been compared using simulations and measurements with the performance for a device without a shield. In the simulations, a multiband planar antenna having a two strip monopole and a meandered strip line was used. The antenna covered an area of 15 mm by 42 mm at one end of the device. A simple, homogeneous spherical model was used for the user's head based on the teaching provided in O Fujiwara et al., "*Electrical properties of skin and SAR calculation in a realistic human model for microwave exposure*", Electrical Engineering in Japan, vol. 120, pp. 66-73, 1997 and Meier et al., "*The dependence of electromagnetic energy absorption upon human-head modelling at* 1800 *MHz*", IEEE Transactions on Microwave Theory and Techniques, vol. MTT-45, pp. 2058-2062, 1997.

The head is modelled with 2 layers. An outer layer is a shell and an inner layer is a liquid. The properties for each layer are set out below. The hand is modelled using a single liquid layer.

| Material | Relative Permittivity (ε) | Conductivity (S/m) |
|---|---|---|
| Shell | 5 | 0.05 |
| Liquid | 42 | 0.99 |

Compliance testing for mobile telecommunications equipment is defined in terms of average SAR values over a tissue mass of 1 g (ANSI-IEEE C95.1-1992, FCC) or 10 g (ICNIRP (April 1998), CENELEC 50166-2). The simulation results for a device being used by a user's head are shown below for different substrates within the shield.

| | Max SAR Without Shield | | | | Max SAR With Shield | | | |
|---|---|---|---|---|---|---|---|---|
| | 1 g (W/kg) | | 10 g (W/kg) | | 1 g (W/kg) | | 10 g (W/kg) | |
| Substrate | 900 MHz | 1800 MHz | 900 MHz | 1800 MHz | 900 MHz | 1800 MHz | 900 MHz | 1800 MHz |
| RT5870 | 9.298 | 2.939 | 6.286 | 1.806 | 3.697 | 0.7118 | 2.579 | 0.4605 |
| R04350B | 9.298 | 2.939 | 6.286 | 1.806 | 3.895 | 2.123 | 2.712 | 1.425 |
| RT5880 | 9.298 | 2.939 | 6.286 | 1.806 | 3.4 | 1.3 | 2.33 | 0.731 |
| CuClad217 | 9.298 | 2.939 | 6.286 | 1.806 | 3.4 | 1.3 | 2.39 | 0.741 |

From the table above, for the shield using a RT5870 substrate in 1 g of tissue SAR values are reduced by 60% at 900 MHz and for same volume at 1800 MHz a reduction of 75% is clear. The same percentage of reduction in SAR values is observed for 10 g of tissue for both 900 MHz and 1800 MHz i.e. 58% and 74%. For the other substrates, all the parameters were kept the same as for the device having an RT5870 substrate. With the R04350B substrate, at 900 MHz there is a reduction of 58% in SAR values for 1 g of tissue. At 1800 MHz for 1 g and 10 g there is a 27.7% and 21% decrease in SAR values respectively. Also, at 900 MHz for 10 g of tissue there is a 57% decrease in SAR. For the flexible substrate made from RT5880, there is a 63.4% decrease in SAR at 900 MHz for 1 g and 55.6% for the same volume at 1800 MHz. For 10 g of tissue, the same amount of reduction is observed at both frequencies which is 64% and 59.5% for 900 MHz and 1800 MHz respectively. Using the Cu-clad217 substrate, the results are again impressive showing a 63.4% decrease in SAR at 900 MHz for 1 g and similarly for 1800 MHz there is a 55.7% decrease. Looking at the 10 g results, a 62% reduction can be seen at 900 MHz and 59% at 1800 MHz. So a shield having any of the selected substrates performs well at both frequencies on a user device close to a user's head.

Simulation results for a device being held in a user's hand as shown in FIG. 4*b* are shown below:

| | Max SAR Without EBG | | | | Max SAR With EBG | | | |
|---|---|---|---|---|---|---|---|---|
| | 1 g (W/kg) | | 10 g (W/kg) | | 1 g (W/kg) | | 10 g (W/kg) | |
| Substrate | 900 MHz | 1800 MHz | 900 MHz | 1800 MHz | 900 MHz | 1800 MHz | 900 MHz | 1800 MHz |
| RT5870 | 3.442 | 0.529 | 2.853 | 0.4105 | 1.684 | 0.2129 | 1.289 | 0.2125 |
| R04350B | 3.442 | 0.529 | 2.853 | 0.4105 | 2.188 | 1.028 | 1.672 | 0.6949 |

For the first substrate, SAR values at both frequencies for 1 g and 10 g have been reduced. For 1 g at 900 MHz there is a 51% reduction and 59.7% at 1800 MHz. For 10 g, a 54% reduction in SAR is observed at 900 MHz and 48% reduction at 1800 MHz. This setup shows that the design reduces the SAR values by half and thus the shield works for both bands.

For the flexible substrate, R04350B, at 900 MHz for 1 g SAR is reduced by 36.3%. At 900 MHz for 10 g the reduction is 41.3% showing that the shield works at 900 MHz. However 1800 MHz results are not as expected. There is an increase in SAR values at both 1 g and 10 g which is 94% in 1 g and 70% in 10 g but they still remain below the European standard of 2 W/kg. So for this setup we can conclude that the designed shield is working only at the 900 MHz band.

Figure 5B:
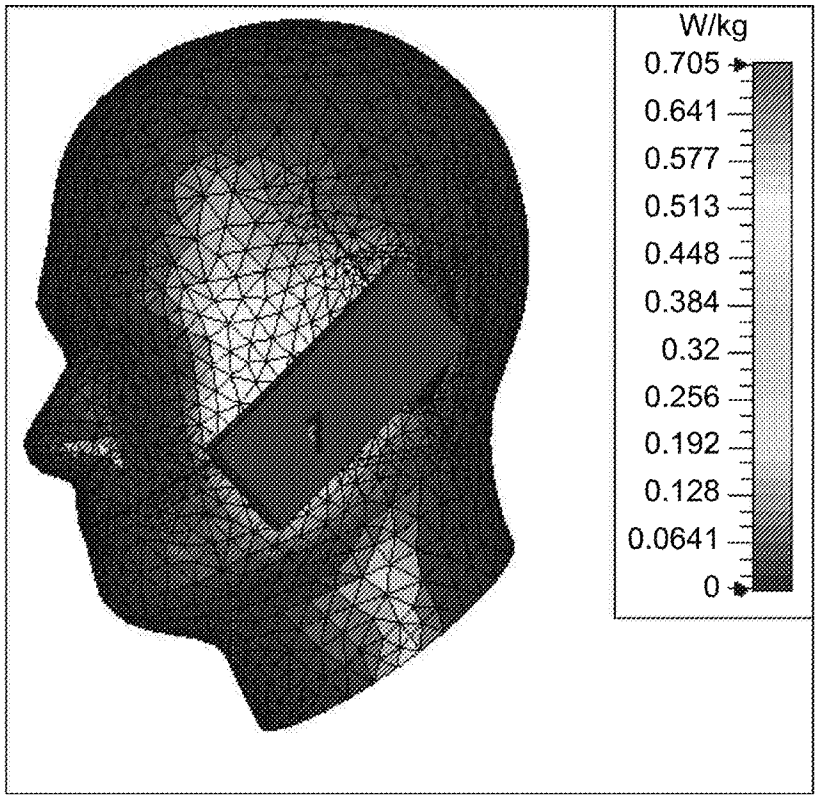
FIGS. 5*a* to 5*h* show the SAR results at 900 MHz and 1800 MHz over 1 g and 10 g of tissue mass without and with a shield, respectively.
Figure 5A:
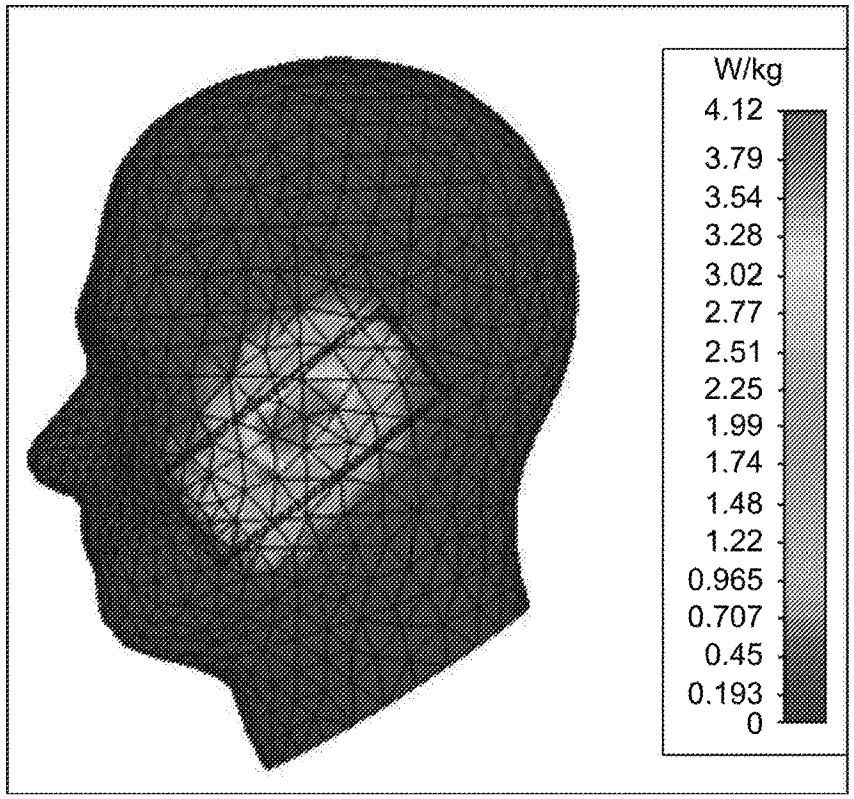
Figure 5C:
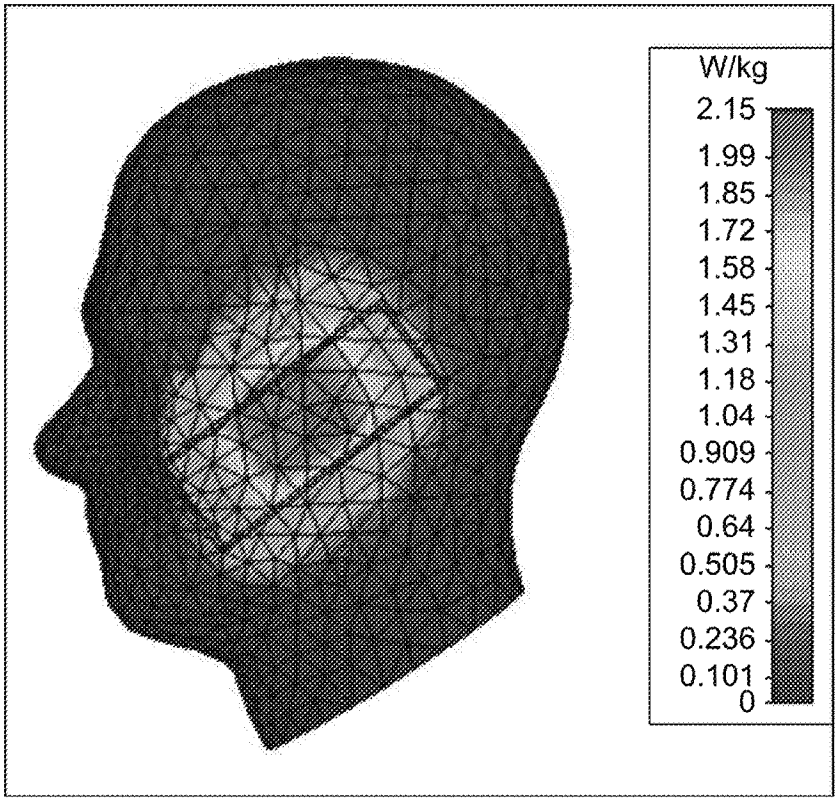
Figure 5D:
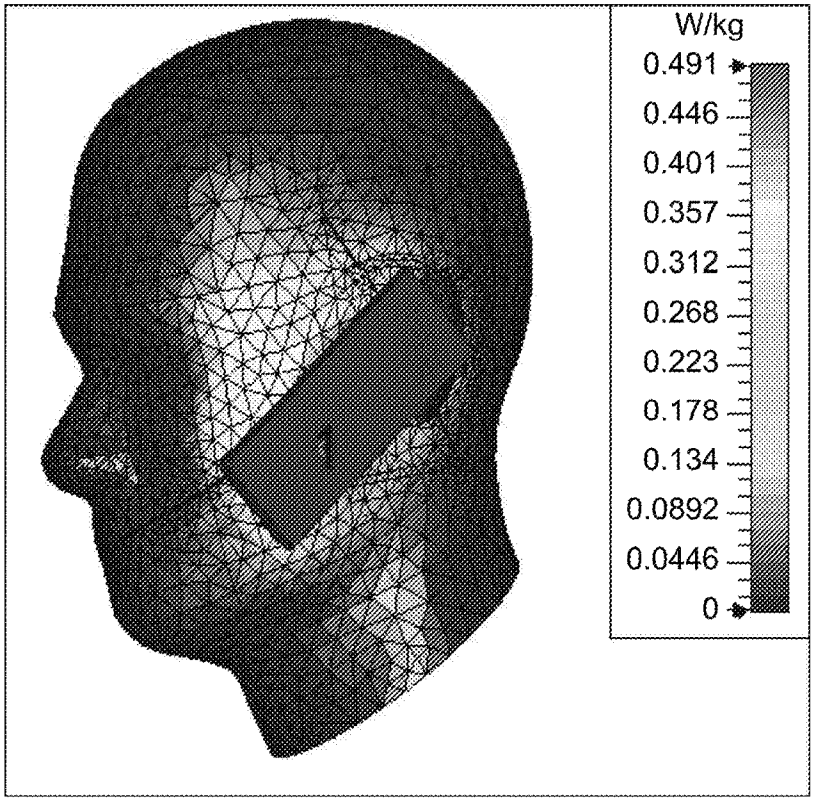
Figure 5F:
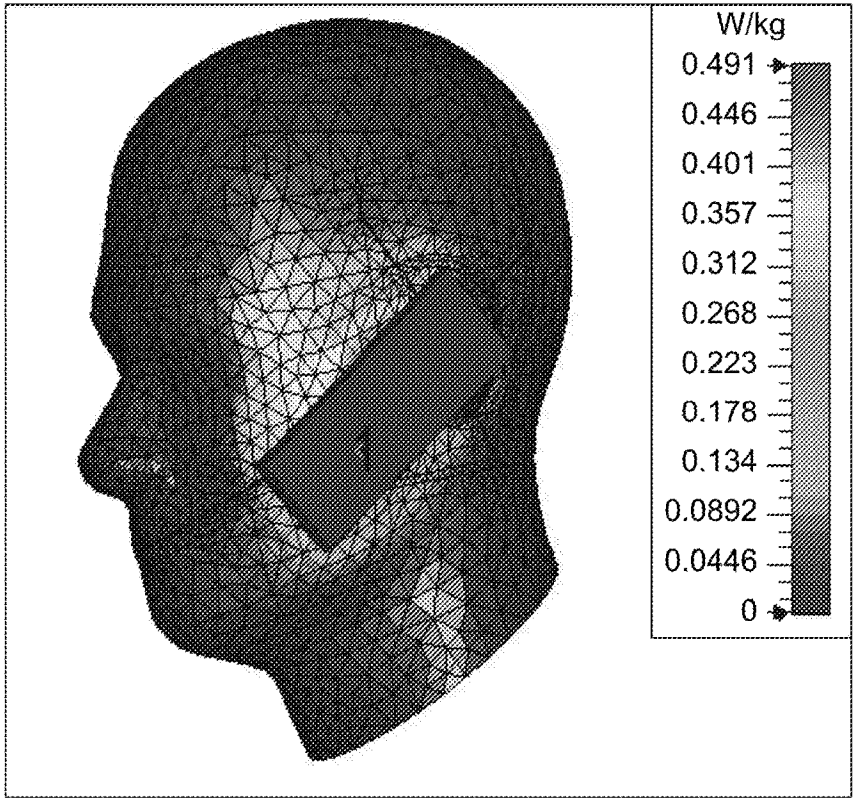
Figure 5E:
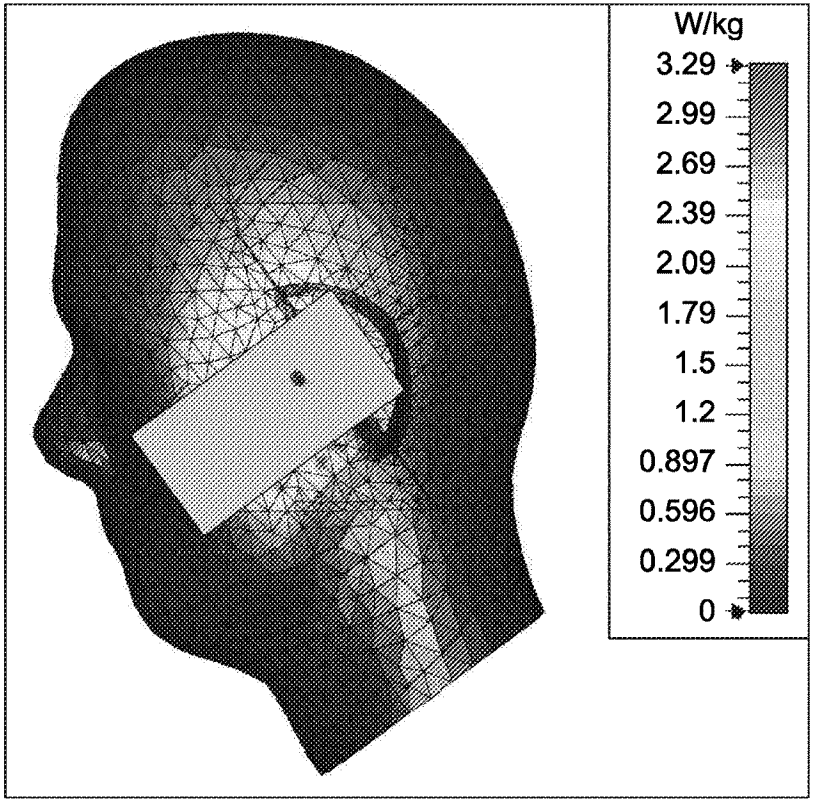
Figure 5H:
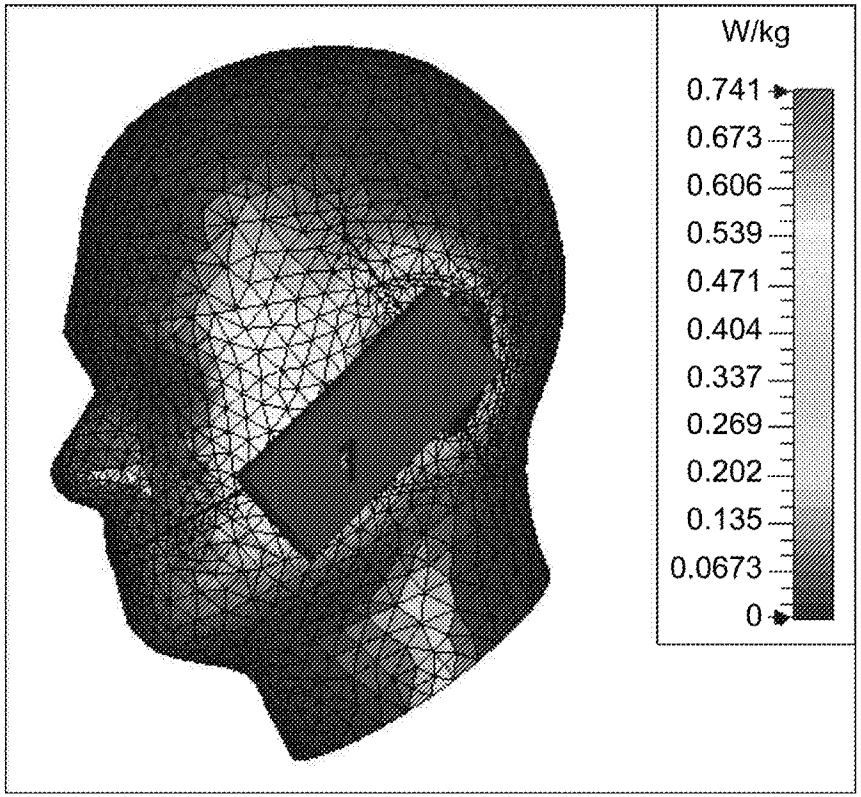
Figure 5G:
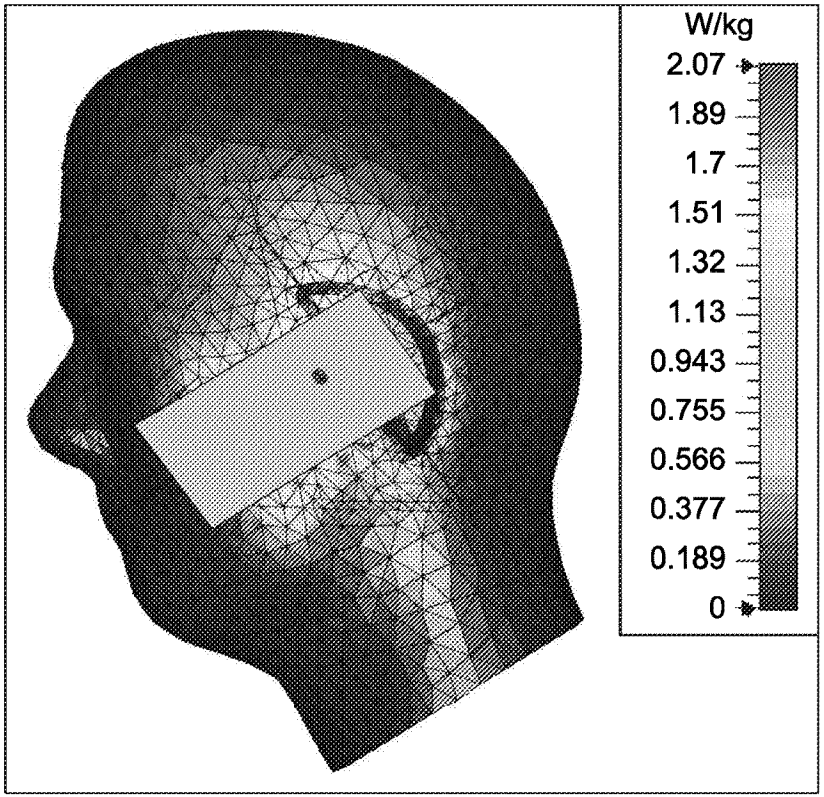

FIGS. 5*a* to 5*h* are simulation results for a user device with and without the shield shown in FIG. 1*a*. FIGS. 5*a* and 5*b* show the SAR results at 900 MHz over 1 g of tissue mass without and with a shield. FIGS. 5*c* and 5*d* show the SAR results at 900 MHz over 10 g of tissue mass without and with a shield. FIGS. 5*e* and 5*f* show the SAR results at 1800 MHz over 1 g of tissue mass without and with a shield. FIGS. 5*g* and 5*h* show the SAR results at 1800 MHz over 10 g of tissue mass without and with a shield. In each case, there is a reduction in the specific absorption rate (SAR) for the shielded device.

Figure 6A:
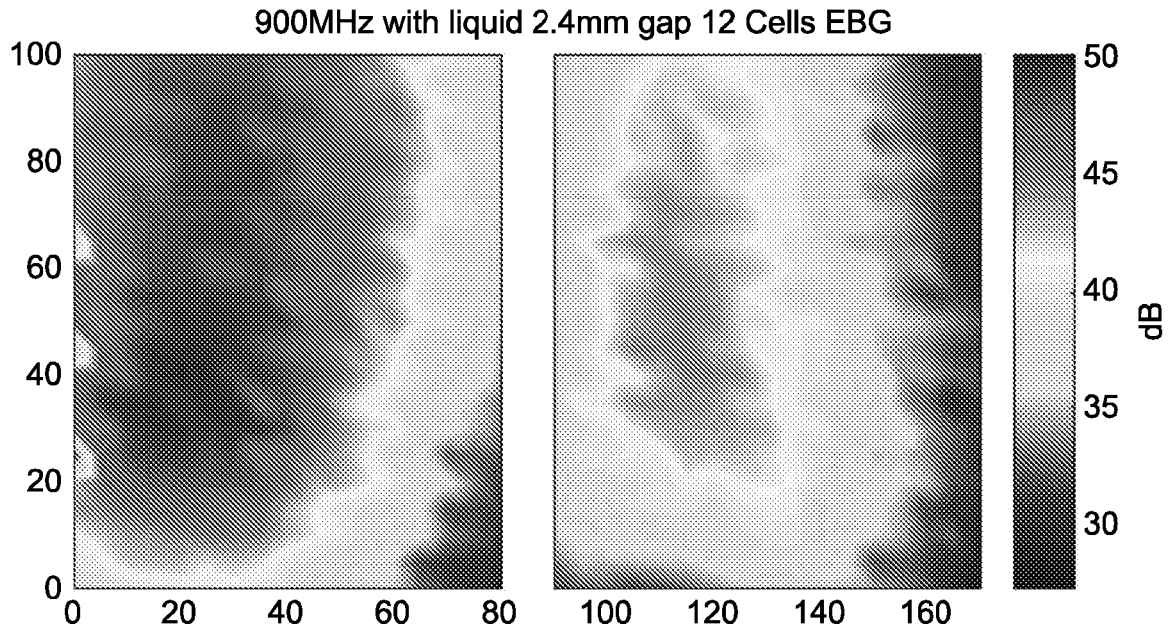
FIGS. 6*a* and 6*b* show the measured results for SAR for a user device without and with a shield.
Figure 6B:
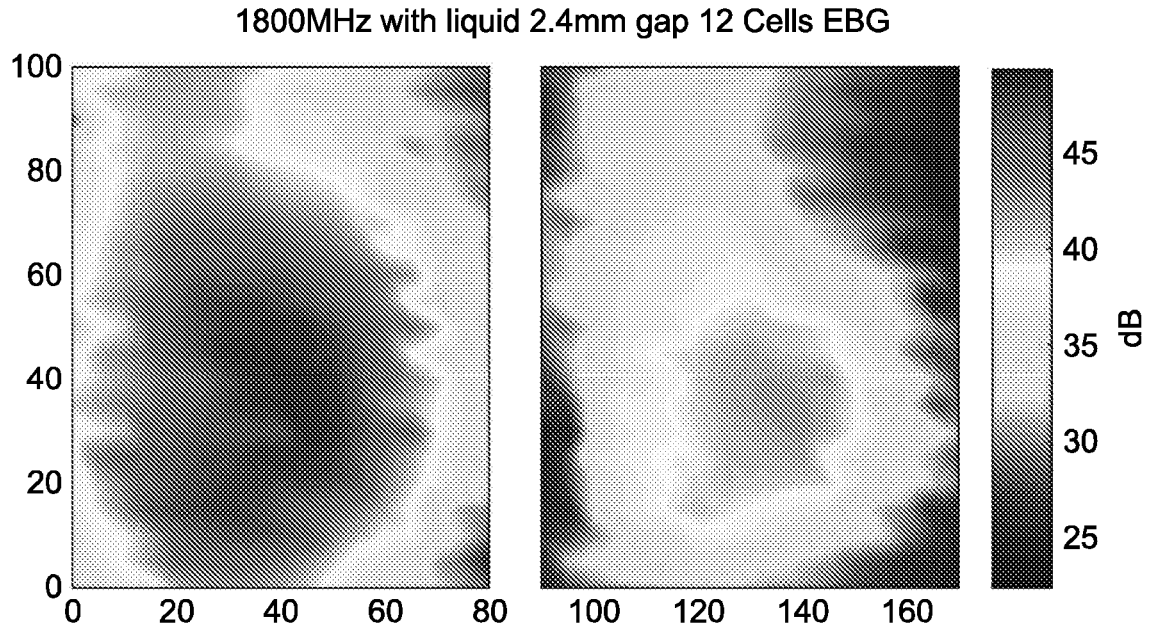
Figure 6C:
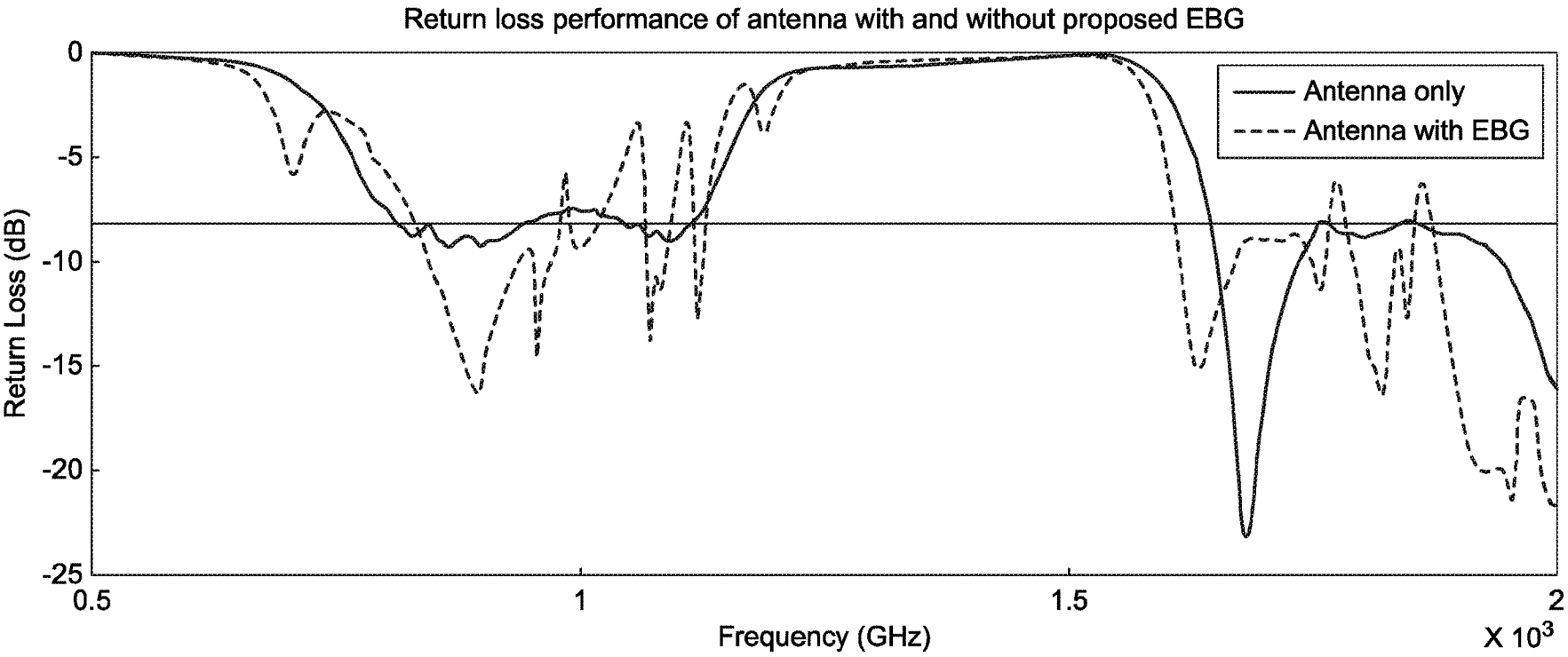
FIG. 6*c* shows the measured return loss in dB against frequency for the antenna in a device with and without the shield.

FIG. 6 shows the measured return loss in dB against frequency for the antenna in a device with and without the shield. FIG. 6 shows that the radiation efficiency of the antenna can be successfully maintained.

Figure 7:
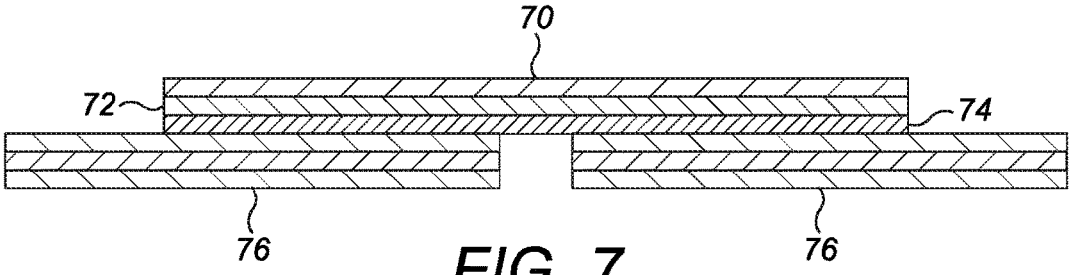
FIG. 7 is a schematic cross-section of a laptop incorporating a shield according to the present invention resting on a user's lap.

The shield can be used with a variety of devices. For example, FIG. 7 is a schematic view of a shield 72 as described before incorporated into a laptop. A base layer 70 of the laptop which incorporates the antenna is adjacent to the shield 72 with the shielding layer adjacent to the base layer 70. An optional protective layer 74, e.g. plastics, is on the opposed surface of the shield 72 to the base layer 70. The laptop rests on a user's leg 76 which are modelled as two 3 mm layers of tissue (liquid) around a 15 mm layer of bone.

| Max SAR Without EBG | | | | Max SAR With EBG | | | |
|---|---|---|---|---|---|---|---|
| 1 g (W/kg) | | 10 g (W/kg) | | 1 g (W/kg) | | 10 g (W/kg) | |
| 900 MHz | 1800 MHz | 900 MHz | 1800 MHz | 900 MHz | 1800 MHz | 900 MHz | 1800 MHz |
| 1.342 | 5.528 | 1.857 | 4.452 | 0.993 | 6.038 | 0.8081 | 3.566 |

A similar result is obtained for SAR values in this setup as well. Above we can see a 26% reduction in SAR at 900 MHz for 1 g of tissue. For 10 g of tissue at 900 MHz, a 56.4% reduction in SAR is clear. However, at 1800 MHz results vary a bit. For 1 g of tissue at 1800 MHz, SAR values increased by 9% while for 10 g of tissue at 1800 MHz the EBG again reduces SAR values by 19.9%. One possible reason for such odd behaviour at 1800 MHz for 1 g could be due to the constant volume approximation used for calculating SAR.

The results obtained from the simulations above were compared with results obtained by measurement. For example, FIGS. 6*a* and 6*b* show the measured results for SAR for a user device without a shield (left side) and with a shield (right). When in use the shield is positioned 2.4 mm from the antenna and has 12 cells as shown in FIG. 1*a*. Both simulation and measured results show that the shield design shown in FIG. 1*a* is capable of reducing the SAR to a very high degree for both the 900 MHz and 1800 MHz bands. The reductions range from 60% to 98% depending upon the simulation setups and the substrate materials. In addition, it is also clear from the results that the size of the total structure can be modified as required for the application without compromising the performance.

Figure 8A:
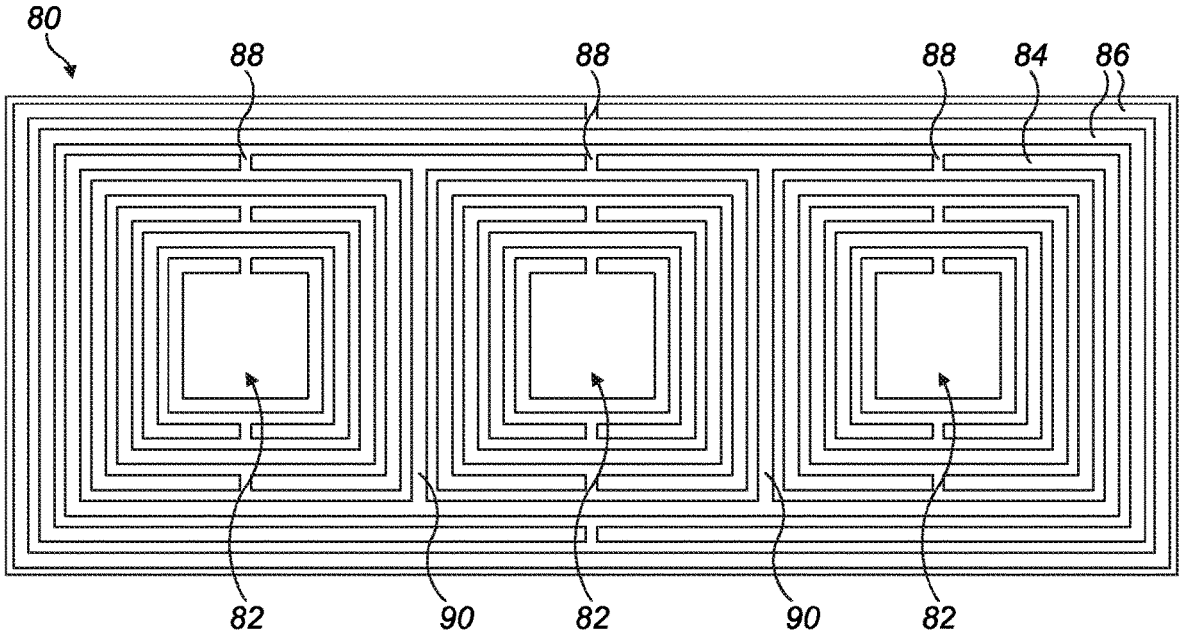
FIG. 8*a* is a plan view of an alternative unit cell incorporating three cell units of FIG. 2*a*.

FIG. 8*a* shows an alternative cell unit 80 which is also an overlapped structure based on three unit cells 82 arranged side-by-side. The cell unit 80 has 15 loops in total with 12 loops (one to four for each unit cell) enclosed inside a common loop 84 effectively formed from three overlapped loops (fifth loop of each cell) and two further outer loops 86. The first to fourth loops of each single cell are identical to those of the cell shown in FIGS. 2*a* and 2*b*. The common loop 84 has a track which forms a loop around all the adjacent cells. The track has three gaps 88 which are each equivalent to the gap 29 in the fifth loop of a single cell. Each of the gaps 88 in the common loop 84 is aligned with and equal in size to the gaps in the first and third loops of the respective single cells. The common loop 84 also has two dividers 90 each of which forms one side of the fifth loop for two adjacent cells. The alternative unit cell is enclosed within two further outer loops 86 with the aim of enhancing the overall shielding performance without degrading antenna efficiency.

Like the dual band cell unit of FIG. 3*a*, the alternative cell unit 80 is also a dual band cell unit which is designed to resonate at different frequencies. Furthermore, in a similar manner to that shown in FIG. 3*a*, to mirror the asymmetry of the single cell, the alternative unit cell 80 groups the single cells together in an asymmetric way. That is to say, the three unit cells form three pairs of cells which are arranged asymmetrically within each individual pair, as described above, and relative to each of the other two pairs.

Figure 8B:
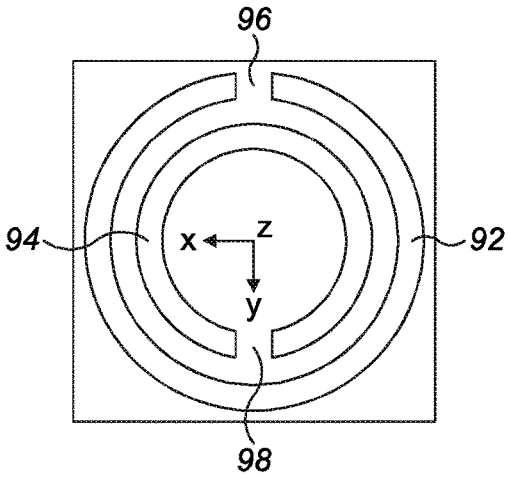
FIG. 8*b* is a schematic view of an alternative design for a cell unit.

FIG. 8*b* shows an alternative design for a unit cell. This unit cell comprises two concentric generally circular split ring resonators 92, 94. It will be appreciated that a different number of split ring resonators may be used. As before a gap 96 in the outer loop 92 is at the opposite position to the position of the first loop 94 having a gap 98. As before, asymmetry can be incorporated into the design, e.g. by adjusting the shape so that it is more oval than circular or varying the alignment of the gaps 96, 98.

Various combinations of optional features have been described herein, and it will be appreciated that described features may be combined in any suitable combination. In particular, the features of any one example embodiment may be combined with features of any other embodiment, as appropriate, except where such combinations are mutually exclusive. Throughout this specification, the term "comprising" or "comprises" means including the component(s) specified but not to the exclusion of the presence of others.

All of the features disclosed in this specification (including any accompanying claims, abstract and drawings), and/or all of the steps of any method or process so disclosed, may be combined in any combination, except combinations where at least some of such features and/or steps are mutually exclusive. Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed. Although a few preferred embodiments of the present invention have been shown and described, it will be appreciated by those skilled in the art that various changes and modifications might be made without departing from the scope of the invention, as defined in the appended claims.

The invention claimed is:

1. A shielding apparatus for passively attenuating electromagnetic radiation comprising:

a plurality of cells with each cell comprising a plurality of resonators which are spaced from one another;

wherein the plurality of cells are arranged in a plurality of unit cells with each unit cell comprising a common loop which surrounds at least two adjacent cells of the plurality of cells; and wherein the plurality of unit cells each have an asymmetric structure so that the shielding apparatus has a negative refractive index for at least one selected frequency whereby electromagnetic radiation at the at least one selected frequency is attenuated; and wherein each of the plurality of resonators in at least one of the plurality of cells is a split ring resonator formed from a loop of conducting material with a gap in the loop.

2. The shielding apparatus of claim 1, wherein the common loop acts as a resonator for each cell within the unit cell.

3. The shielding apparatus of claim 1, wherein at least one of the plurality of unit cells comprises a first cell having a first pair of adjacent resonators and a second cell having a second pair of adjacent resonators wherein a spacing between the first pair of adjacent resonators is different from a spacing between the second pair of adjacent resonators whereby the at least one of the plurality of unit cells has an asymmetric structure.

4. The shielding apparatus of claim 1, wherein each of the plurality of resonators in at least one of the plurality of unit cells has a width which is different from its length whereby at least one of the plurality of unit cells has an asymmetric structure.

5. The shielding apparatus of claim 1, wherein the gap on a first resonator within a cell is at an opposed position to a position of the gap on a second resonator within the cell.

6. The shielding apparatus of claim 1, wherein each of the plurality of resonators in at least one of the plurality of cells are concentric with one another.

7. The shielding apparatus of claim 1, wherein at least one of the plurality of unit cells has a spacing between the common loop and an adjacent resonator of each cell within the unit cell wherein the spacing is non-uniform whereby the at least one of the plurality of unit cells has an asymmetric structure.

8. The shielding apparatus of claim 1, wherein each unit cell comprises at least two additional resonators surrounding the common loop.

9. The shielding apparatus of claim 8, wherein the additional resonators are split ring resonators and a gap in a first additional resonator is positioned at an opposite end of the unit cell to gap in a second additional resonator.

10. The shielding apparatus of claim 1, wherein each unit cell has a negative refractive index for two selected frequencies whereby electromagnetic radiation at the two selected frequencies is passively attenuated.

11. The shielding apparatus of claim 1, wherein the plurality of cells are in a shielding layer mounted on a substrate.

12. The shielding apparatus of claim 11, wherein the substrate is formed from a dielectric material.

13. The shielding apparatus of claim 11, wherein the substrate is formed from a flexible material.

14. The shielding apparatus of claim 11, wherein the plurality of cells is printed on the substrate.

15. A user device incorporating the shielding apparatus of claim 1, the user device comprising:

an emitter emitting electromagnetic radiation;

wherein the shielding apparatus is located adjacent the emitter such that in use the shielding apparatus is between the user and the emitter.

16. The user device of claim 15, wherein the number of cells in the plurality of cells is such that a surface area of the shielding device matches a surface area of the user device.

17. An item of clothing incorporating the shielding apparatus of claim 1.

18. A shielding apparatus for passively attenuating electromagnetic radiation comprising:

a plurality of cells with each cell comprising a plurality of resonators which are spaced from one another;

wherein the plurality of cells are arranged in a plurality of unit cells with each unit cell comprising a common loop which surrounds at least two adjacent cells of the plurality of cells; and wherein the plurality of unit cells each have an asymmetric structure so that the shielding apparatus has a negative refractive index for at least one selected frequency whereby electromagnetic radiation at the at least one selected frequency is attenuated;

wherein each unit cell comprises at least two additional resonators surrounding the common loop; and wherein the additional resonators are split ring resonators and a gap in a first additional resonator is positioned at an opposite end of the unit cell to gap in a second additional resonator.

* * * * *